US007220492B2

(12) United States Patent
Fick et al.

(10) Patent No.: US 7,220,492 B2
(45) Date of Patent: May 22, 2007

(54) METAL MATRIX COMPOSITE ARTICLES

(75) Inventors: Michael J. Fick, Maplewood, MN (US); James P. Sorensen, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 491 days.

(21) Appl. No.: 10/740,299

(22) Filed: Dec. 18, 2003

(65) Prior Publication Data

US 2005/0133188 A1 Jun. 23, 2005

(51) Int. Cl.

| | |
|---|---|
| ***B32B 5/08*** | (2006.01) |
| ***B32B 5/02*** | (2006.01) |
| ***B32B 3/06*** | (2006.01) |
| ***B32B 3/02*** | (2006.01) |
| ***B32B 15/14*** | (2006.01) |

(52) U.S. Cl. ..... 428/592; 428/611; 428/614; 428/687; 428/293.1

(58) Field of Classification Search ..... None
See application file for complete search history.

(56) References Cited

U.S. PATENT DOCUMENTS

| | | | |
|---|---|---|---|
| 3,429,722 | A | 2/1969 | Economy et al. |
| 3,795,524 | A | 3/1974 | Sowman |
| 3,945,070 | A | 3/1976 | Hauser |
| 4,047,965 | A | 9/1977 | Karst et al. |
| 4,705,093 | A | 11/1987 | Ogino |
| 4,852,630 | A | 8/1989 | Hamajima et al. |
| 4,922,863 | A | 5/1990 | Adams |
| 4,932,099 | A | 6/1990 | Corwin |
| 4,954,462 | A | 9/1990 | Wood et al. |
| 5,199,481 | A | 4/1993 | Corwin et al. |
| 5,234,045 | A | 8/1993 | Cisko |
| 5,234,080 | A | 8/1993 | Pantale |
| 5,273,098 | A | 12/1993 | Hyndman et al. |
| 5,303,761 | A | 4/1994 | Flessner et al. |
| 5,394,930 | A | 3/1995 | Kennerknecht |
| 5,780,154 | A | 7/1998 | Okano et al. |
| 5,887,684 | A | 3/1999 | Doll et al. |
| 5,921,312 | A | 7/1999 | Carden |
| 6,035,923 | A | 3/2000 | Oda et al. |
| 6,205,959 | B1 | 3/2001 | Smetan et al. |
| 6,458,297 | B2 | 10/2002 | Moschini |
| 6,478,073 | B1 | 11/2002 | Grebe et al. |
| 6,564,856 | B1 | 5/2003 | Buckley |
| 2002/0088599 | A1 | 7/2002 | Davis et al. |

FOREIGN PATENT DOCUMENTS

| | | |
|---|---|---|
| GB | 2 182 970 A | 5/1987 |
| JP | 62-297521 | 12/1987 |
| WO | WO 85/04605 | 10/1985 |

*Primary Examiner*—Jennifer McNeil
*Assistant Examiner*—Jason L. Savage

(57) ABSTRACT

Mold components comprising soluble cores, metal matrix composite articles, and methods of making metal matrix composite articles.

18 Claims, 3 Drawing Sheets

METAL MATRIX COMPOSITE ARTICLES

This invention was made with Government support under Agreement No. N68936-97-3-0005 awarded by the Naval Air Warfare Center Weapons Division, U.S. Navy. The Government has certain rights in the invention.

FIELD

The present invention pertains to metal matrix composite articles, and methods for making metal matrix composite articles, particularly methods using a soluble core.

BACKGROUND

In general, the reinforcement of metal matrices with ceramics is known in the art. Examples of ceramic materials used for reinforcement include particles, discontinuous fibers (including whiskers) and continuous fibers, as well as ceramic pre-forms. Typically, ceramic material is incorporated into a metal to produce a metal matrix composite (MMC) having improved mechanical properties as compared to the metal itself.

Some articles undergo post-formation machining (e.g., the creation of holes, threads, or other elements requiring the removal of material to provide a desired shape). Conventional MMC articles typically contain sufficient ceramic reinforcement material to make the machining impractical or at least undesirable. Typically, the presence of the ceramic material quickly wears the cutting tool away making machining of the MMC undesirable. Hence, it is preferred to produce "net-shaped" or "near net-shaped" articles that require little, or no, post-formation machining or processing. In general, techniques for making net-shaped articles are known in the art (e.g., U.S. Pat. No. 5,234,045 (Cisko) and U.S. Pat. No. 5,887,684 (Döll et al.)).

In addition, or alternatively, to the extent feasible, the ceramic reinforcement may be reduced or not placed in areas where it will interfere with machining and/or other processing such as welding. For example, metal sleeves and/or inserts may be used in conjunction with the MMC article, with the post-formation machining substantially limited to the sleeves and/or inserts. However, this construction may lead to a weak interface between the MMC casting and the metal sleeve and/or insert.

Another consideration in designing and making MMC articles is the cost of the ceramic reinforcement material itself. Although, the mechanical properties of ceramic materials such as, for example, some continuous polycrystalline alpha-alumina fibers are high compared to low-density metals such as aluminum, the cost of such ceramic oxide materials is typically substantially more than metals such as aluminum. Hence, it is desirable to minimize the amount of ceramic oxide material used, and to try to optimize placement of the ceramic oxide materials in order to maximize the properties imparted by the ceramic oxide materials.

In some embodiments, it is desirable to provide MMC articles having ceramic material in areas of high stress. In another aspect, in some embodiments, it is desirable to form net-shaped MMC articles (e.g., net-shaped, threaded MMC articles).

SUMMARY

In one aspect, the present invention provides a metal matrix composite article comprising a first major surface, the first major surface including a first thread, wherein the first thread comprises a first metal matrix composite, and wherein the first metal matrix composite comprises a first metal and a first plurality of substantially continuous fibers substantially aligned with the first thread. In some embodiments, the first metal is selected from the group consisting of aluminum, magnesium, and alloys thereof. In some embodiments, the first thread has a helix angle of about zero degrees.

In some embodiments, the first major surface of a metal matrix composite article further comprises at least one additional thread (e.g., a second thread). In some embodiments, the helix angle of the first thread and the helix angle of the second thread are substantially the same. In some embodiments, the first thread and the second thread are interspersed. In some embodiments, the second thread comprises a second metal. In some embodiments, the first metal and the second metal are the same metal. In some embodiments, the second thread comprises a second plurality of substantially continuous fibers. In some embodiments, the first plurality of fibers and the second plurality of fibers comprise the same material.

In some embodiments, the metal matrix composite article further comprises a third plurality of substantially continuous fibers. In some embodiments, an angle between a major axis of the first plurality of fibers and a major axis of the third plurality of fibers is between 30 degrees and 60 degrees.

In some embodiments, the metal matrix composite article further comprises a second major surface opposite the first major surface, optionally wherein the second surface comprises a third thread.

In another aspect, the present invention provides a mold component comprising a soluble core having a first major surface and a first plurality of substantially continuous fibers adjacent at least a portion of the first major surface. In some embodiments, the soluble core comprises a salt. In some embodiments, the soluble core is water-soluble.

In some embodiments, the first major surface of the mold component comprises a first groove, optionally wherein the first plurality of fibers is substantially aligned with the first groove.

In yet another aspect, the present invention provides a method of making a metal matrix composite article. In one embodiment, the method comprises providing a soluble core having a first major surface, the first major surface comprising a first region wrapped with a first plurality of substantially continuous fibers;

infiltrating the first plurality of fibers with a first molten metal; and solidifying the first metal.

In some embodiments, the method further comprises removing the soluble core. In some embodiments, removing the soluble core comprises exposing the core to a fluid in which it is soluble, optionally wherein the fluid is selected from the group consisting of water, steam, and combinations thereof. In some embodiments, the method further comprises applying a second molten metal over the first molten metal and solidifying the second molten metal, optionally wherein the first molten metal and the second molten metal are the same.

In some embodiments, the method further comprises creating a first groove in the first region of the soluble core, and optionally wherein the first plurality of fibers is substantially aligned with the first groove.

In some embodiments, the first major surface of the soluble core further comprises a second region, optionally wherein the second region at least partially overlaps the first region, wherein the method further comprises applying a second plurality of substantially continuous fibers to the second region of the core, infiltrating the second plurality of fibers with a third molten metal, optionally wherein the first molten metal and the third molten metal are the same metal.

In yet another aspect, the present invention provides a threaded article comprising a cylinder having an interior major surface comprising a thread, wherein the thread comprises a metal and a plurality of substantially continuous fibers. In some embodiments, the plurality of substantially continuous fibers is substantially aligned with the thread. In some embodiments, the plurality of substantially continuous fibers have an aspect ratio of greater than 200. In some embodiments, the plurality of substantially continuous fibers has an average length of at least 5 centimeters.

In some embodiments, the present invention provides soluble cores suitable for producing near net-shaped and/or net-shaped MMC articles requiring little or no post-formation machining. In some embodiments, the use of the soluble cores according to the present invention reduces waste and post-formation machining.

In another aspect, some embodiments of the present invention provide mold components comprising a soluble core and one or more plies of substantially continuous fibers.

In another aspect, some embodiments of the present invention provide MMC articles having substantially continuous fibers substantially aligned with features (e.g., threads) of the MMC articles.

In some embodiments, the substantially continuous fibers are selected from the group consisting of metal fibers, ceramic fibers, graphite fibers, and combinations thereof. In some embodiments, the substantially continuous fibers are selected from the group consisting of alumina fibers, (e.g., alpha-alumina fibers), aluminosilicate fibers, aluminoborosilicate fibers, boron nitride fibers, silicon carbide fibers, and combinations thereof.

In some embodiments, the present invention facilitates the attachment of additional structural members (e.g., fin sections and/or nose cones) to a high strength, high modulus, lightweight structural element.

In some embodiments, the present invention provides a relatively lightweight structural element (for example, a projectile tube) having a similar coefficient of thermal expansion (CTE) in both the threaded section and in the bulk of the structural element.

In yet another aspect, some embodiments of the present invention provide a method of providing net-shaped and/or near net-shaped features (e.g., threads) on a MMC article, thereby reducing and/or eliminating the need to perform significant additional processing steps (e.g., grinding) near the end of the manufacturing process.

The above summary of the present invention is not intended to describe each embodiment of the present invention. The details of one or more embodiments of the invention are also set forth in the description below. Other features and advantages of the invention will be apparent from the description and from the claims.

DETAILED DESCRIPTION

In some applications, it is desirable to connect a part comprising a metal matrix composite (MMC) article to one or more additional articles (e.g., a metal article or another MMC article). For example, one method of connecting articles comprises mating a female threaded article with a male threaded article (e.g., mating a female threaded nut with a male threaded bolt, or connecting two male threaded pipes with a female threaded coupling). With this approach, threads are typically formed on the respective articles such that the articles will mate when the threads are aligned and engaged.

In one aspect of the present invention, soluble cores are used to facilitate the formation of threads in MMC articles. In some embodiments, the use of a soluble core reduces the amount of MMC material that is removed to create the threads. In some embodiments, the threads are net-shaped or near net-shaped (i.e., little or no subsequent processing (e.g., grinding or polishing) is needed).

In another aspect of the present invention, some embodiments of the mold component (i.e., a soluble core and one or more plies of substantially continuous fibers) are used to form MMC articles that have substantially the same coefficient of thermal expansion (CTE) in both the threaded region and the bulk of the MMC article.

Referring to FIGS. 1A–1E, one exemplary method for making an exemplary MMC article according to the present invention is illustrated. Generally, a soluble core is wrapped with one or more plies of substantially continuous fibers, forming a mold component. The mold component is placed in a mold where metal infiltrates the fibers forming a MMC region. Optionally, one or more additional MMC regions and/or metal regions (i.e., regions without fibers) may be formed in the same or subsequent casting step(s). After the final casting step, the soluble core is dissolved with an appropriate solvent (e.g., water) yielding a MMC article. Optional machining steps such as grinding and/or polishing may then be performed (e.g., in some embodiments, threads may be machined into the MMC article).

Figure 1A:
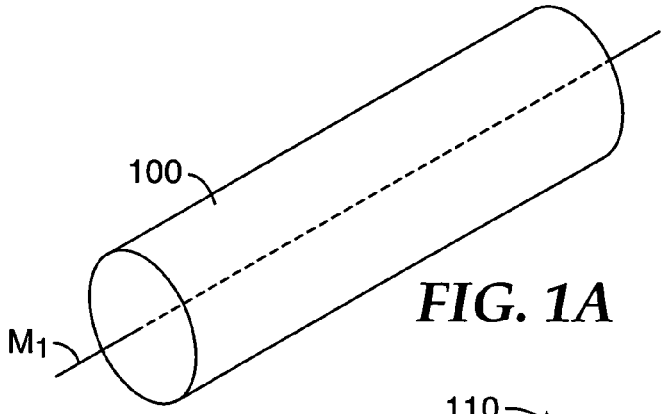
FIG. 1A illustrates an exemplary soluble core useful in making embodiments of metal matrix composite articles according to the present invention.

More specifically, FIG. 1A illustrates an exemplary soluble core 100. Soluble cores may be formed from any soluble material. In some embodiments, a soluble core comprises a material soluble in a fluid (e.g., a liquid (e.g., water) and/or a gas (e.g., steam)). In some embodiments, the soluble core comprises a salt (e.g., soda ash (available, for example, under the trade name "ALUMINUM CASTING SALT AC" from Heatbath/Park Metallurgical Corp., Indian Orchard, Mass.), or sodium chloride).

In some embodiments, the soluble core may comprise a combination of soluble and insoluble materials. For example, the core may comprise a salt combined with sand and/or a ceramic material (e.g., oxides, nitrides, and carbides), wherein the ceramic material may be incorporated in a variety of forms (e.g., whiskers, fibers, particulates, and/or platelets). In some embodiments, the core may comprise an insoluble member (e.g., a rod or bar), at least a portion of which is covered by a soluble layer, wherein the soluble layer may comprise, for example, a soluble material, or a combination of soluble and insoluble materials.

Additional suitable materials for making soluble cores are described, for example, in U.S. Pat. No. 5,273,098 (Hyndman et al.), U.S. Pat. No. 5,921,312 (Carden), and U.S. Pat. No. 6,478,073 (Grebe et al.).

Although soluble core 100 is shown as a cylinder with major axis $M_1$, any of a variety of core shapes and sizes may be used depending, for example, on the desired size and shape of the resulting MMC article or portion of such article formed using the core. Suitable cores can be formed by techniques known in the art (e.g., injecting molten salt into a die, pressing, sintering, casting (e.g., lost-foam casting), and combinations thereof). Further, the shape of the core may be modified by a variety of known techniques (e.g., machining, turning, and grinding). Suitable core-forming methods are described, for example, in U.S. Pat. No. 5,273,098 (Hyndman et al.) and U.S. Pat. No. 5,303,761 (Flessner et al.).

Figure 1B:
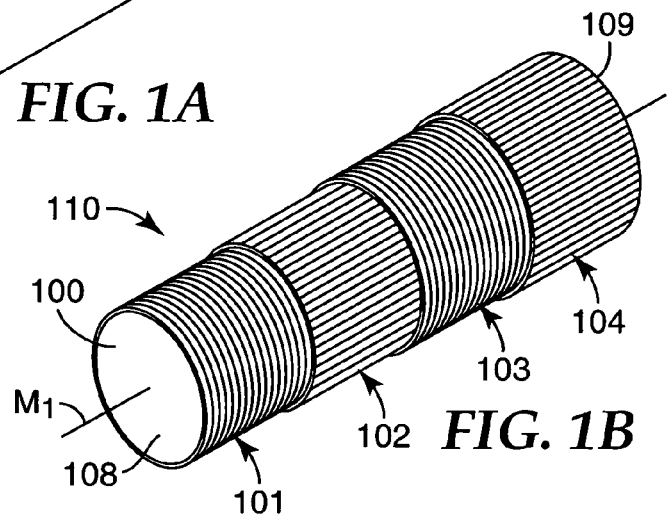
FIG. 1B illustrates an exemplary mold component according to the present invention, comprising the soluble core of FIG. 1A wrapped with multiple plies of fibers.

Further, FIG. 1B illustrates mold component 110, comprising soluble core 100 and four plies of continuous fibers applied to core 100 (i.e., plies 101, 102, 103, and 104). A ply is at least one layer of substantially continuous fibers. In some embodiments, the fibers are reinforcing fibers. Each ply (i.e., plies 101, 102, 103, and 104) spans the length of core 100 (i.e., from first end 108 to second end 109). For clarity, the upper plies (i.e., plies 102, 103, and 104) have been truncated to expose the lower plies.

"Substantially continuous fiber" means a fiber having a length that is relatively infinite when compared to the average fiber diameter. Typically, with regard to the present invention, the substantially continuous fibers have lengths of at least 5 centimeters (cm) (in some embodiments, at least 10 cm, 15 cm, 20 cm, or even at least 25 cm; in some embodiments, in a range from 5 to 25 cm). Typically, at least about 85% by number of the fibers in the finished MMC articles are substantially continuous (in some embodiments, at least about 90%, or even at least about 95%). In some embodiments, substantially all (i.e., greater than 95% by number, or greater than 98%, or even greater than 99%) of the fibers in the finished MMC article are substantially continuous. In some embodiments, the substantially continuous fibers have an aspect ratio (i.e., the ratio of fiber length over average fiber diameter) of greater than 200 (in some embodiments, greater than 500, greater than 1000, greater than 2000, greater than 10,000, greater than 25,000, or even greater than 50,000).

In some embodiments, the substantially continuous fibers of a particular ply are substantially longitudinally aligned such that they are generally parallel to each other. Typically, it is desirable that all of the substantially continuous fibers in a particular ply are maintained in a substantially longitudinally aligned configuration where individual fiber alignment is maintained within ±10° (in some embodiments, ±5°, or even ±3°), of their average longitudinal axis (i.e., the major axis of the ply).

While these fibers may be incorporated in a particular ply as individual fibers, they are more typically incorporated as a group of fibers (e.g., roving (i.e., a loose assemblage of fibers in a single strand without twists or with a slight twist), yarn (i.e., an assembly of fibers twisted together), or tows (i.e., a plurality of (individual) fibers (typically at least 100 fibers, more typically at least 400 fibers) collected in a rope-like form). In some embodiments, fiber groups (i.e., rovings, yarns, or tows) comprise at least 750 individual fibers per group (or even at least 2550 individual fibers per group). In some embodiments, the fibers may be incorporated in a ply as part of a prepreg material (i.e., substantially continuous fibers embedded in a resin (e.g., epoxy)).

Fibers within a group of fibers are maintained in a substantially longitudinally aligned (i.e., generally parallel) relationship with one another. When multiple groups of fibers are used to form a ply, the groups of fibers are also maintained in a substantially longitudinally aligned (i.e., generally parallel) relationship with one another. Substantially continuous fibers in the form of woven, knitted, and the like fiber constructions may be useful, but typically are less desirable because they are not conducive to providing the higher fiber packing densities realized with longitudinally aligned fibers. Thus, metal infiltrated articles based on mold components using woven, knitted, or the like fiber constructions typically exhibit lower strength properties than metal infiltrated articles having longitudinally aligned continuous fibers and hence are less desirable.

For some constructions, it may be desirable or necessary for the longitudinally aligned fibers to be curved, as opposed to straight (i.e., they do not extend in a planar manner (e.g., fibers wrapped circumferentially around a cylinder)). Hence, for example, the longitudinally aligned fibers may be planar throughout the fiber length, non-planar (i.e., curved) throughout the fiber length, or they may be planar in some portions and non-planar (i.e., curved) in other portions, wherein the continuous fibers are maintained in a substantially non-intersecting, curvilinear (i.e., longitudinally aligned) arrangement throughout their curved portion(s). In some embodiments, the fibers are maintained in a substantially equidistant relationship with each other throughout their curved portion(s).

Referring again to FIG. 1B, first ply of substantially continuous fibers 101 is wrapped circumferentially about core 100, perpendicular to major axis $M_1$. Second ply of substantially continuous fibers 102 is wrapped parallel to major axis $M_1$ of core 100, overlapping first ply of fibers 101. Other orientations of the plies of continuous fibers are possible (e.g., a ply may be aligned at any angle relative to major axis $M_1$ from zero degrees (i.e., parallel to major axis $M_1$) to 90 degrees (i.e., perpendicular to major axis $M_1$). Furthermore, each ply of fibers may be applied at any angle relative to one or more other plies of fibers. Although depending on the particular application, the difference in the orientation of a ply with respect to another ply or plies may be anywhere between greater than zero degrees to 90°. In some embodiments, the positioning of a ply with respect to another ply or plies may be in the range from about 30° to about 60°, or even, for example, in the range from about 40° to about 50°.

In some embodiments, only one ply of substantially continuous fibers is applied to a soluble core to form a mold component, while in other embodiments, two or more plies of substantially continuous fibers are applied to the soluble core. For example, in FIG. 1B, four plies of substantially continuous fibers are shown, with third ply of substantially continuous fibers 103, and fourth ply of substantially continuous fibers 104 applied in circumferential and parallel orientations, respectively.

In some embodiments, a first ply of substantially continuous fibers is coextensive with a soluble core. In some embodiments, the first ply of substantially continuous fibers is only applied to selected regions of the soluble core. Subsequent plies of substantially continuous fibers can be independently applied to selected regions of the soluble core, including, for example, coextensive with the soluble core. In some embodiments, a subsequent ply of fibers may overlap all or a portion of one or more other plies of fibers. In some embodiments, a subsequent ply may abut, but not overlap one or more other plies. In some embodiments, a subsequent ply may be spaced some lateral distance away from one or more other plies. For example, in some embodiments, a first ply of substantially continuous fibers may be applied to one region of the soluble core, while a second ply of substantially continuous fibers may be applied to a second region of the soluble core.

Examples of substantially continuous fibers that may be useful for making MMC articles according to the present invention include ceramic fibers, such as metal oxide fibers (e.g., alumina fibers, alpha aluminum oxide fibers, aluminosilicate fibers, and aluminoborosilicate fibers), boron fibers, boron nitride fibers, graphite fibers, and silicon carbide fibers. Typically, the ceramic oxide fibers are crystalline ceramics and/or a mixture of crystalline ceramic and glass (i.e., a fiber may contain both crystalline ceramic and glass phases). The fibers of a particular ply may comprise one specie of fibers or the ply may comprise two or more species of fibers.

In some embodiments, the fibers have an average tensile strength of at least 1.4 gigapascals (GPa), (in some embodiments, at least 1.7 GPa, at least 2.1 GPa, or even at least 2.8 GPa). In some embodiments, the fibers have a Young's modulus of at least 70 GPa (in some embodiments, at least 100 GPa, at least 150 GPa, at least 200 GPa, at least 250 GPa, at least 300 GPa, or even at least 350 GPa).

Typically, the substantially continuous fibers have average diameters in a range of from 5 micrometers to 250 micrometers, more typically, 5 micrometers to 100 micrometers, although for tows of fibers, the average fiber diameter is typically no greater than 50 micrometers, and more typically, no greater than 25 micrometers. In some embodiments, the fibers have a cross-sectional shape that is circular or elliptical.

Methods for making alumina fibers are known in the art and include the method disclosed in U.S. Pat. No. 4,954,462 (Wood et al.). In some embodiments, the alumina fibers are polycrystalline alpha alumina-based fibers and comprise, on a theoretical oxide basis, greater than about 99 percent by weight $Al_2O_3$ and about 0.2 to 0.5 percent by weight $Fe_2O_3$, based on the total weight of the alumina fibers. In some embodiments, polycrystalline, alpha alumina-based fibers comprise alpha alumina having an average grain size of less than 1 micrometer (or even less than 0.5 micrometer). In some embodiments, polycrystalline, alpha alumina-based fibers have an average tensile strength of at least 1.6 GPa (in some embodiments, at least 2.1 GPa, or even at least 2.8 GPa). Exemplary alpha alumina fibers are commercially available under the trade designation "NEXTEL 610" from 3M Company, St. Paul, Minn. Another exemplary alpha alumina fiber comprises about 89 percent by weight $Al_2O_3$, about 10 percent by weight $ZrO_2$, and about 1 percent by weight $Y_2O_3$, based on the total weight of the fibers, and is marketed by 3M Company under the trade designation "NEXTEL 650."

Suitable aluminosilicate fibers are described in, for example, U.S. Pat. No. 4,047,965 (Karst et al.). In some embodiments, the aluminosilicate fibers comprise, on a theoretical oxide basis, in the range from 67 to 85 percent by weight $Al_2O_3$ and in the range from 33 to 15 percent by weight $SiO_2$, based on the total weight of the aluminosilicate fibers. Some exemplary aluminosilicate fibers comprise, on a theoretical oxide basis, in the range from 67 to 77 percent by weight $Al_2O_3$ and in the range from 33 to 23 percent by weight $SiO_2$, based on the total weight of the aluminosilicate fibers. In some embodiments, the aluminosilicate fibers comprise, on a theoretical oxide basis, about 85 percent by weight $Al_2O_3$ and about 15 percent by weight $SiO_2$, based on the total weight of the aluminosilicate fibers. Another exemplary aluminosilicate fiber comprises, on a theoretical oxide basis, about 73 percent by weight $Al_2O_3$ and about 27 percent by weight $SiO_2$, based on the total weight of the aluminosilicate fibers. Aluminosilicate fibers are commercially available, for example, from 3M Company under the trade designations "NEXTEL 720" and "NEXTEL 550."

Suitable aluminoborosilicate fibers are described, for example, in U.S. Pat. No. 3,795,524 (Sowman). In some embodiments, the aluminoborosilicate fibers comprise, on a theoretical oxide basis, 35 percent by weight to 75 percent by weight (in some embodiments, 55 percent by weight to 75 percent by weight) $Al_2O_3$; greater than 0 percent by weight (in some embodiments, at least 15 percent by weight) and less than 50 percent by weight (in some embodiments, less than 45 percent by weight, or even less than 44 percent by weight) $SiO_2$; and greater than 1 percent by weight $B_2O_3$, based on the total weight of the aluminoborosilicate fibers. In some embodiments, the aluminoborosilicate fibers comprise greater than 5 percent by weight $B_2O_3$. In some embodiments, the aluminoborosilicate fibers comprise less than about 25 percent by weight $B_2O_3$. In some embodiments, the aluminoborosilicate fibers comprise about 1 percent by weight to about 5 percent by weight, or about 2 percent by weight to about 20 percent by weight $B_2O_3$. Aluminoborosilicate fibers are commercially available, for example, from the 3M Company under the trade designations "NEXTEL 312" and "NEXTEL 440."

Exemplary boron fibers are commercially available, for example, from Specialty Materials, Inc. of Lowell, Mass.

Boron nitride fibers can be made, for example, as described in U.S. Pat. No. 3,429,722 (Economy) and U.S. Pat. No. 5,780,154 (Okano et al.).

Exemplary carbon fibers are commercially available, for example, from BP Amoco Chemicals of Alpharetta, Ga. under the trade designation "THORNEL CARBON" in tows of 2000, 4000, 5000, and 12,000 fibers, from Hexcel Corporation of Stamford, Conn., from Grafil, Inc. of Sacramento, Calif. (subsidiary of Mitsubishi Rayon Co.) under the trade designation "PYROFIL", from Toray of Tokyo, Japan under the trade designation "TORAYCA", from Toho Rayon of Japan, Ltd. under the trade designation "BESFIGHT", from Zoltek Corporation of St. Louis, Mo. under the trade designations "PANEX" and "PYRON", and from Inco Special Products of Wyckoff, N.J. (nickel coated carbon fibers) under the trade designations "12K20" and "12K50".

Exemplary graphite fibers are commercially available, for example, from BP Amoco of Alpharetta, Ga. under the trade designation "T-300" in tows of 1000, 3000, and 6000 fibers.

Exemplary silicon carbide fibers are commercially available, for example, from COI Ceramics of San Diego, Calif. under the trade designation "NICALON" in tows of 500 fibers, from Ube Industries of Japan under the trade designation "TYRANNO", and from Dow Corning of Midland, Mich. under the trade designation "SYLRAMIC".

Commercially available substantially continuous fibers (e.g., ceramic oxide fibers) typically include an organic sizing material added to the fibers during their manufacture to provide lubricity and to protect the fiber strands during handling. It is believed that the sizing tends to reduce the breakage of fibers, static electricity, and the amount of dust during, for example, conversion to a fabric. The sizing can be removed (e.g., by dissolving or burning it away). In some embodiments, the substantially continuous fibers may be water-sized. It is also within the scope of the present invention to have other coatings on the substantially continuous fibers. Such coatings may be used, for example, to enhance the wettability of the fibers, and/or to reduce or prevent reaction between the fibers and the molten metal matrix material. The coatings and techniques for providing the coatings are known in the fiber and metal matrix composite art.

A mold component can be used to form MMC articles according to the present invention using techniques known in the art including, for example, pressure infiltration casting, squeeze casting, gravity casting, investment casting, or centrifugal casting. Generally, the mold component is positioned within the mold cavity. Metal is then introduced into the mold cavity. In some exemplary embodiments, the metal is introduced as solid pieces that are subsequently melted in situ. In some exemplary embodiments, the metal is introduced in a molten state. Typically, pressure is applied (e.g., by pressurized gas, gravity, a piston, and/or centrifugal force) to force the molten metal to infiltrate the plies of substantially continuous fibers, encapsulating the individual fibers and forming a metal matrix composite region. Optionally, depending on, for example, the shape of the mold cavity, metal may also surround the mold component forming a metal region (i.e., a region without fibers). The final MMC article comprises both the metal matrix composite region(s) and the metal region(s), if any are present. In some embodiments, the mold cavity may be selected to minimize the metal region of a MMC article.

The mold cavity can have any of a variety of shapes depending, for example, on the desired shape of the MMC article. In some embodiments, a multiple-step casting process may be used to form the MMC article. An exemplary two-step process for forming an MMC article comprises placing a mold component in a first mold where a first metal infiltrates the plies of substantially continuous fibers forming a first metal matrix composite region, and, optionally, a first metal region. The mold component is then moved to a second mold having a larger mold cavity, and a second metal is applied forming a second metal region. In some embodiments, the first metal and the second metal are the same.

In some embodiments, more than two molds and/or casting steps are used. In some embodiments, an additional ply or plies of fibers may be introduced between casting steps. In some embodiments, two or more metals may be introduced to the mold during a single casting step. Both the fibers and the metal(s) used in each casting step are independently selected and may be the same as or different from the fibers and/or metal(s) used in other casting steps.

Typically, the metal of the metal matrix composite is selected such that the matrix material does not significantly react chemically with the fiber material (i.e., is relatively chemically inert with respect to fiber material), for example, to eliminate the need to provide a protective coating on the fiber exterior. Examples of typical suitable metals include aluminum, iron, titanium, nickel, cobalt, copper, tin, magnesium, zinc, and alloys thereof. In some embodiments, the metals for the MMC articles may be selected from the group consisting of aluminum, magnesium, and alloys thereof (e.g., alloys of aluminum with magnesium, copper, silicon, chromium, and combinations thereof (e.g., an alloy of aluminum and copper comprising at least about 98 percent by weight aluminum and up to about 2 percent by weight copper)). In some embodiments, the metal comprises at least 98 percent by weight aluminum (in some embodiments, at least 99, 99.9, or even greater than 99.95 percent by weight aluminum). In some embodiments, useful alloys are 200, 300, 400, 700, and/or 6000 series aluminum alloy. Although higher purity metals tend to be desirable for making higher tensile strength elongated metal matrix composite articles, less pure forms of metals are also useful.

Suitable metals are commercially available. For example, aluminum is available under the trade designation "SUPER PURE ALUMINUM; 99.99% Al" from Alcoa of Pittsburgh, Pa. Aluminum alloys (e.g., Al-2 percent by weight Cu (0.03 percent by weight impurities)) can be obtained, for example, from Belmont Metals, New York, N.Y. For example, magnesium is available under the trade designation "PURE" from Magnesium Elektron, Manchester, England. Magnesium alloys (e.g., WE43A, EZ33A, AZ81A, and ZE41A) can be obtained, for example, from TIMET, Denver, Colo.

Figure 1C:
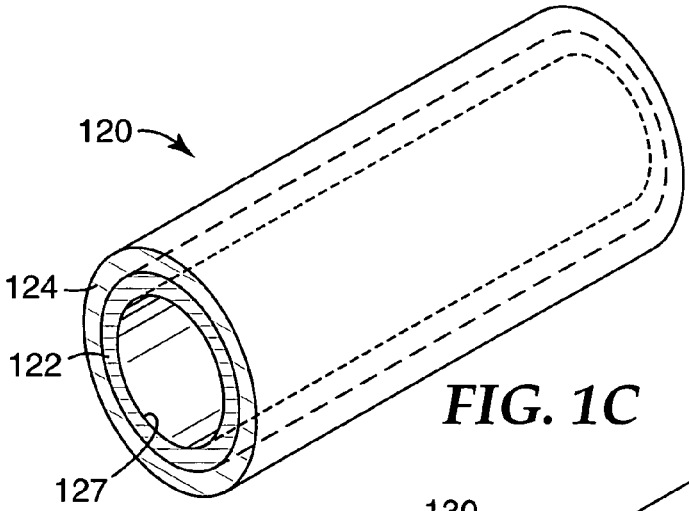
FIG. 1C illustrates an exemplary metal matrix composite article according to the present invention cast using the mold component of FIG. 1B, after the soluble core has been removed.

Turning to FIG. 1C, MMC article 120 is illustrated, after a casting step and after the soluble core (not shown) has been removed to expose interior major surface 127. MMC article 120 comprises MMC region 122 and metal region 124. Generally, a MMC region comprises the ply or plies of substantially continuous fibers and the metal that infiltrated and encapsulated the fibers of these plies, while a metal region is free of fibers. Generally, a variety of known techniques may be used to remove the core. For example, the core may be removed by dissolution in a fluid (e.g., a liquid (e.g., water) and/or a gas (e.g., steam)). In some embodiments, for example, the core may be removed by directing one or more streams (e.g., jets) of solvent (e.g., water and/or steam) at the salt core. In some embodiments, the solvent may contain a filler material (e.g., salt and/or sand) that provides mechanical action to aid in breaking-up and removing the soluble core. In some embodiments, for example, the core may be removed in a liquid bath, wherein the MMC and the soluble core are submerged in a solvent.

In some embodiments, it may be desirable to dissolve the core while the MMC article is still hot. In some embodiments, it may be desirable to create a passage (e.g., a hole) into and even through the soluble core for example, to increase the surface area of the core in contact with the solvent. Generally, the material(s) composing the soluble core (e.g., the soluble and/or insoluble materials) are collected and recycled.

If undercuts, threads and/or other patterns are desired in the MMC article, one or more grinding and/or polishing steps may be performed to form the desired shapes. Generally, a variety of known techniques may be used to create the desired shapes including, for example, diamond grinding.

Figure 1D:
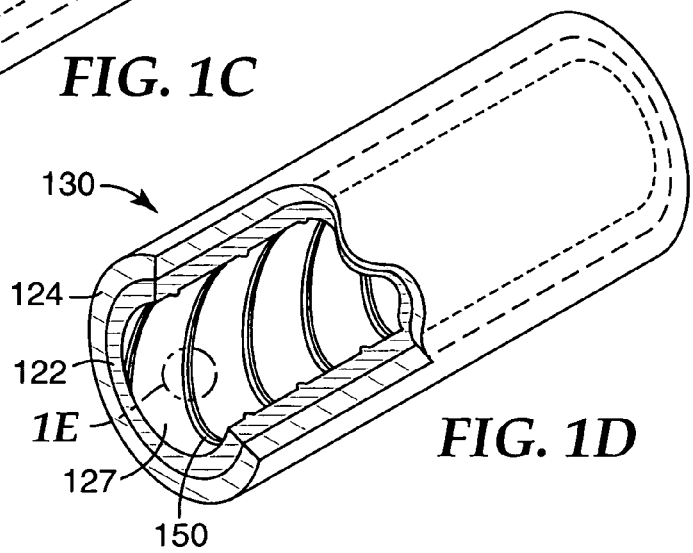
FIG. 1D illustrates a cut-away view of the metal matrix composite article of FIG. 1C after threads have been machined into the interior major surface of the metal matrix composite article.

Referring to FIG. 1D, MMC article 130 with threads 150 formed on interior major surface 127, is shown.

Figure 1E:
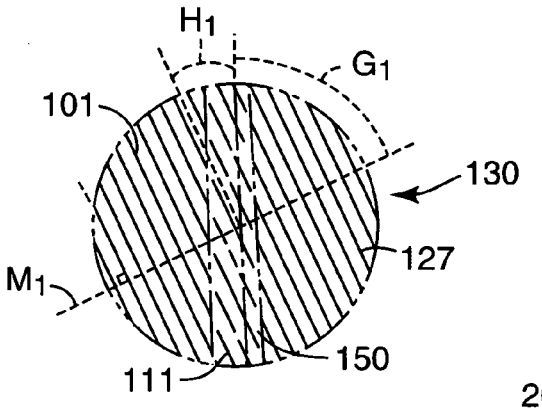
FIG. 1E illustrates an expanded view of a threaded region of the metal matrix composite article of FIG. 1D.

Referring to FIG. 1E, an expanded view of a threaded region of MMC article 130 is shown. In FIG. 1E, MMC article 130 is shown by shadow lines so that the encapsulated fibers can be shown. First ply of substantially continuous fibers 101 forms an angle of 90° with major axis $M_1$. In contrast, threads 150, which have a helix angle $H_1$, form an angle $G_1$ (i.e., 90°-$H_1$) with major axis $M_1$. Thus, the fibers of first ply 101 are not aligned with threads 150. Also, when MMC material was removed (e.g., by grinding) from interior surface 127 to form threads 150, individual fibers 111 in first ply 101 were severed; therefore, fibers 111 in threads 150 are no longer substantially continuous.

Figure 4B:
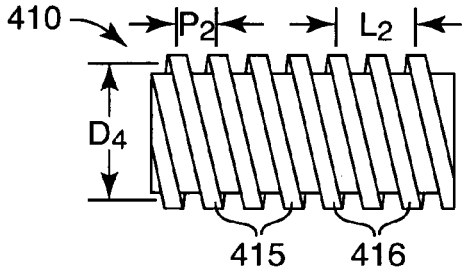
FIG. 4B illustrates an exemplary threaded article having a plurality of interspersed threads having the same helix angle.
Figure 4A:
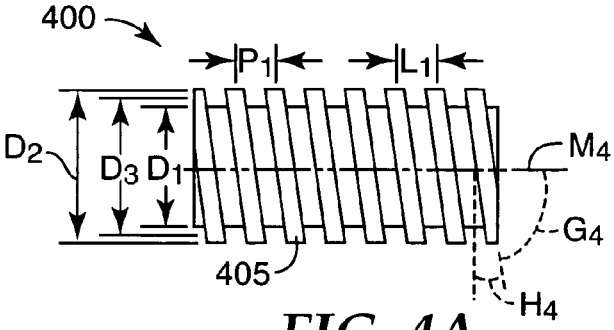
FIG. 4A illustrates an exemplary threaded article having a single thread.

Turning to FIGS. 4A and 4B, the definition of the helix angle of a thread is illustrated. Although FIGS. 4A and 4B illustrate external threads (i.e., threads on the external surface of a cylinder), the same definitions for the helix angle, mean diameter, pitch, and lead apply to articles having internal threads (e.g., threaded pipes).

The helix angle of a thread is measured relative to a line perpendicular to the axis of the threaded article about which the thread winds. Referring to FIG. 4A, threaded article 400 with single-start thread 405 helically winding about major axis $M_4$, is shown. Threaded article 400 has major diameter $D_2$, minor diameter $D_1$, and mean diameter $D_3$, wherein mean diameter $D_3$ is the average of major diameter $D_2$ and minor diameter $D_1$. For a single-start thread, pitch $P_1$(i.e., the distance between similar points on adjacent threads) is equal to lead $L_1$ (i.e., the distance a nut threaded onto threaded article 400 would travel along threaded article 400 if it were rotated one full turn). Generally, the tangent of the helix angle is equal to the lead divided by the product of pi times the mean diameter. Thus, helix angle $H_4$ is defined as $$\tan(H_4)=L_1/\pi D_3.$$

Because helix angle $H_4$ is defined relative to a line perpendicular to axis $M_4$ of threaded article 400, about which single-start thread 400 winds, the angle of single-start thread 400 relative to axis $M_4$ (i.e., angle $G_4$) is equal to 90°-$H_4$. A thread having a helix angle of zero degrees is known in the art as a zero-degree thread or a buttress groove, and such a thread would be perpendicular to the major axis of the article about which it winds.

Referring to FIG. 4B, threaded article 410, with mean diameter $D_4$ and a double-start thread comprising first thread 415 and second 416 is shown. Threads 415 and 416 are interspersed (i.e., the region of threaded article 410 spanned by thread 415 overlaps the region spanned by thread 416, however threads 415 and 416 do not intersect). For a double-start thread, lead $L_2$ is equal to twice pitch $P_2$. As with a single-start thread, the tangent of the helix angle is equal to the lead divided by the product of pi and the mean diameter. Triple-start and higher order threads are also possible.

Referring to FIGS. 2A–2D, a second exemplary method for making an exemplary MMC article according to the present invention is shown. Generally, a soluble core having a groove corresponding to a desired thread pattern is prepared. A first ply of substantially continuous fibers is applied to the core, positioned within, and substantially aligned with the groove. Optionally, one or more additional plies of substantially continuous fibers are applied to the soluble core, forming a mold component. The mold component is placed in a mold and metal infiltrates the fibers forming a MMC region and, optionally, a metal region. Optionally, one or more additional MMC regions and/or metal regions may be formed in the same or subsequent casting steps. After being removed from the mold, the soluble core is removed (e.g., by dissolution with an appropriate solvent (e.g., water and/or steam)). Optionally, finishing steps such as grinding and/or polishing may then be performed. In some embodiments, the MMC article is near net-shaped or net-shaped, minimizing or eliminating the need for finishing steps.

Figure 2A:
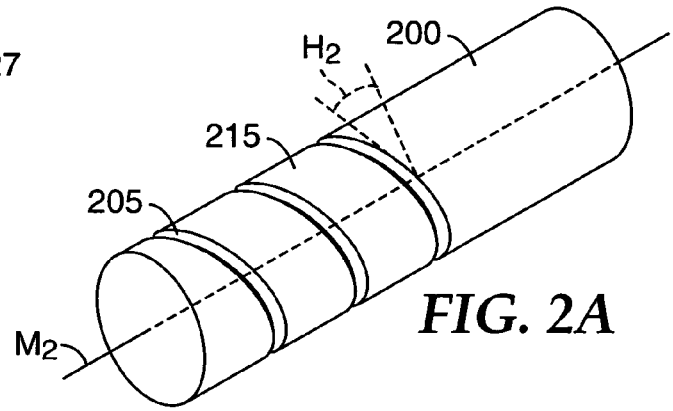
FIG. 2A illustrates a second exemplary soluble core useful in making embodiments of metal matrix composite articles according to the present invention, wherein the soluble core has a helical groove in its major surface.

More specifically, FIG. 2A illustrates soluble core 200 with groove 205 recessed into surface 215 of core 200. Although core 200 is shown as a cylinder with major axis $M_2$, any of a variety of core shapes and sizes may be used depending, for example, on the desired size and shape of the resulting MMC article or portion of such article formed using the core. Similarly, although core 200 is shown with groove 205 recessed into surface 215 of core 200, suitable cores may have any desired raised or relief structure formed on surface 215, depending, for example, on the desired surface features of the MMC article formed using the core. Generally, recessed features on the surface of a core will correspond to raised features on the surface of the MMC article formed with that core. Likewise, raised features on the surface of a core will typically correspond to recessed features on the surface of the MMC article. Furthermore, although groove 205 is shown having a rectangular cross-section, a raised or recessed feature on the surface of a core (e.g., a groove) may have any desired cross-section (e.g., triangular, truncated-triangular, and ACME thread), depending, for example, on the desired cross-section of the resulting features on the finished MMC article.

Groove 205 is a helix having a helix angle $H_2$. Generally a helix angle may be any angle between zero degrees and 90 degrees. In some embodiments, a plurality of grooves may be formed in a soluble core. The helix angle of each groove may be independently selected. In some embodiments, the helix angles of the groove are substantially the same (i.e., the helix angle of each groove is within ±5 degrees (or ±3 degrees, or even ±1 degree) of the average helix angle of the plurality of grooves. In some embodiments, the grooves are interspersed (i.e., the grooves are interlaced without overlapping). In some embodiments, a first groove is formed in a first region of the soluble core and a second groove is formed in a second region of the soluble core.

In some embodiments, soluble core 200 with groove 205 is formed directly using techniques known in the art (e.g., molding or casting). Additionally, or alternatively, soluble core 200 may be produced by a combination of forming techniques (e.g., molding and/or casting) and known machining techniques (e.g., grinding and/or turning). For example, a base soluble core may be formed by, for example, a molding and/or casting technique. Subsequent machining techniques (e.g., grinding) may then be used to transform the base soluble core into the desired final shape (e.g., a cylinder with a helical groove).

Figure 2B:
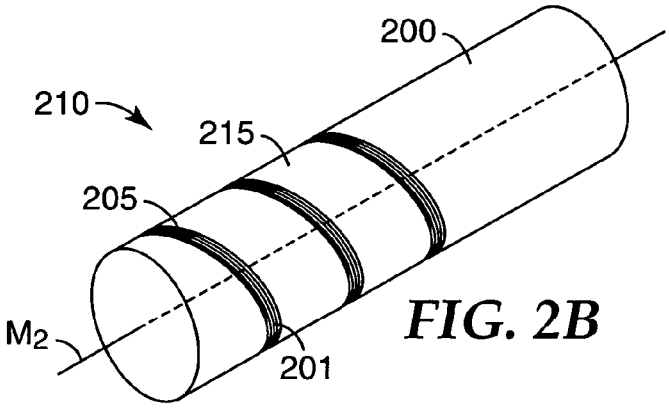
FIG. 2B illustrates a second exemplary mold component according to the present invention comprising fibers wrapped around the soluble core of FIG. 2A, wherein the fibers are aligned with the helical groove.

Further, FIG. 2B illustrates an exemplary embodiment of a mold component of the present invention. Mold component 210 comprises first ply of substantially continuous fibers 201 applied to soluble core 200. The fibers of first ply 201 are located within and are substantially aligned with groove 205. In some embodiments, the first ply substantially fills the groove. In some embodiments, some fibers of the first ply are substantially flush with surface 215 of the soluble core. Generally, the use of substantially aligned fibers reduces the void volume among the fibers. Typically, the void volume is less than about 60% (in some embodiments, less than about 50%, or even less than about 40%).

Figure 2C:
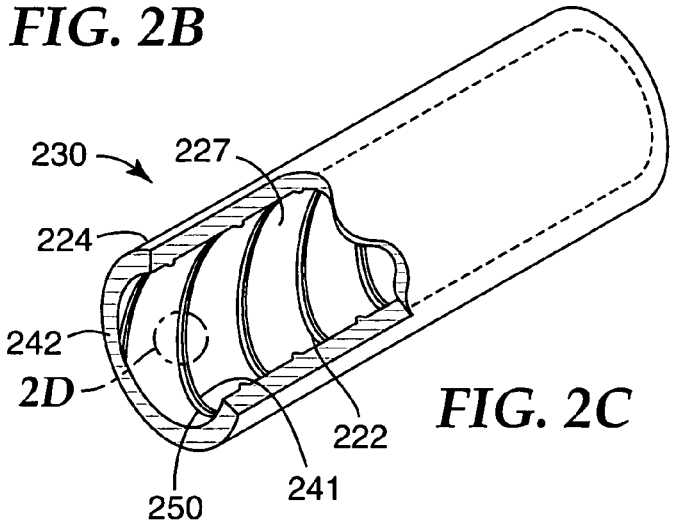
FIG. 2C illustrates an exemplary metal matrix composite article according to the present invention cast using the mold component of FIG. 2B, after the soluble core has been removed.

Next, FIG. 2C illustrates exemplary MMC article 230 after a casting step and after the soluble core has been removed. MMC article 230 comprises MMC region 222 and metal region 224. MMC region 222 comprises first ply 201 (not shown) and first metal 241 that infiltrated first ply 201. In some embodiments, a MMC region comprises less than about 60% by volume metal (in some embodiments, less than about 50% by volume metal, or less than about 45% by volume metal, less than about 40% by volume metal, or less even less than about 35% by volume metal).

MMC region 222 comprises thread 250, located on interior major surface 227. Thread 250 corresponds to groove 205 (shown in FIG. 2B) of soluble core 200 (shown in FIG. 2B). Metal region 224 comprises second metal 242. Each metal (i.e., first metal 241 and second metal 242) is independently selected and may be the same metal or different metals. In some embodiments, the MMC region and the metal region are formed in the same casting operation. In some embodiments, the MMC region and the metal region are formed in separate casting operations. In some embodiments, additional plies of substantially continuous fibers can be applied to soluble core 200 before the casting steps. In some embodiments, the region of the MMC article adjacent the threads will comprise a metal matrix composite region.

Figure 2D:
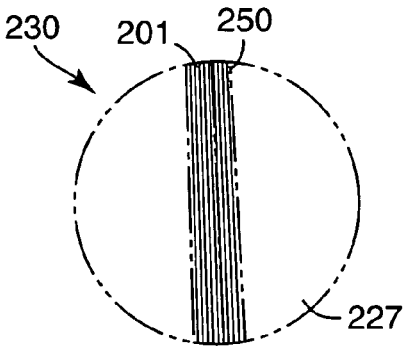
FIG. 2D is an expanded view of a threaded region of the metal matrix composite article of FIG. 2C.

Referring to FIG. 2D, an expanded view of a threaded region of MMC article 230 is shown. In FIG. 2D, MMC article 230 is shown by shadow lines so that the encapsulated fibers can be shown. First ply of substantially continuous fibers 201 is substantially aligned with thread 250. In some embodiments, the thread can be used to attach MMC article 230 to another article (e.g., a second MMC article, or a metal article).

If no, or substantially no, metal infiltrated the soluble core during the casting steps, the MMC article may be ready for use. Such an article is described as "net-shaped" as it requires no subsequent grinding steps or the like. If an undesirable amount of metal infiltrated the soluble core, it may be necessary to remove some metal from the surface of the MMC article (e.g., by grinding). Such an article is called "near net-shaped." In either case, it is not necessary to machine threads into the MMC article. Typically, the fibers located within the threads of a near net-shaped or net-shaped article are substantially continuous (i.e., they are not severed by, for example, grinding).

Figure 3A:
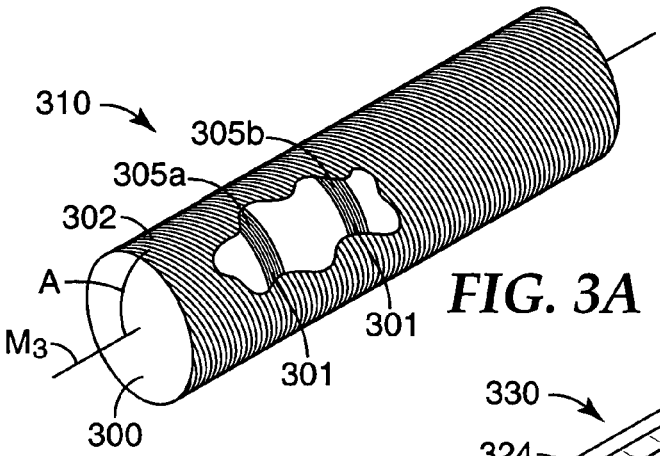
FIG. 3A illustrates a third exemplary mold component useful in making embodiments of metal matrix composite articles according to the present invention, wherein the soluble core has a series of grooves formed in its major surface.
Figure 3B:
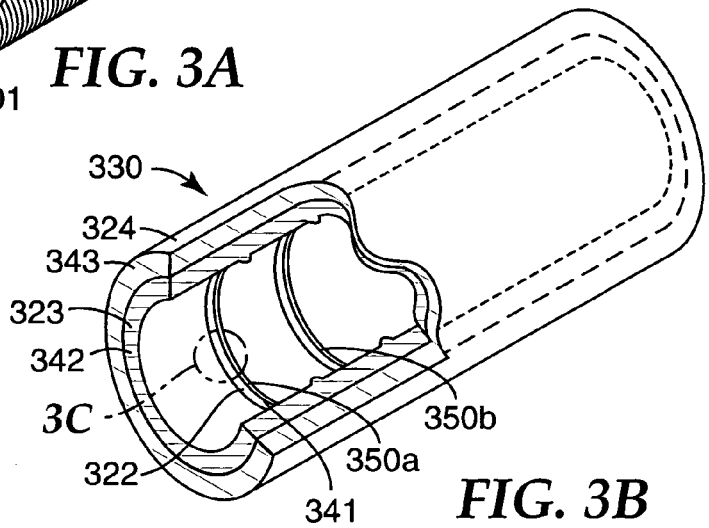
FIG. 3B illustrates a third exemplary metal matrix composite article according to the present invention cast using the mold component of FIG. 3B, after the soluble core has been removed.
Figure 3C:
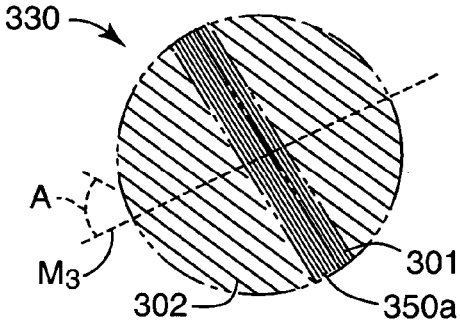
FIG. 3C is an expanded view of a threaded region of the metal matrix composite article of FIG. 3B.

Referring to FIGS. 3A–3C, a third exemplary method for making an exemplary MMC article according to the present invention is shown.

Referring to FIG. 3A, another exemplary embodiment of a mold component according to present invention is shown. Mold component 310 comprises soluble core 300 with first ply of substantially continuous fibers 301 and second ply of substantially continuous fibers 302. First ply 301 is located within first groove 305*a* and second groove 305*b*, both of which have a helix angle of zero degrees.

Second ply 302 wraps soluble core 300, overlapping ply 301. (For purposes of illustration, a portion of second ply 302 has been removed to reveal first ply 301.) The fibers of second ply 302 are aligned such that the major axis of the fibers forms angle A with major axis $M_3$ of soluble core 300. Angle A may be any angle between zero degrees and 90 degrees, inclusive. In some embodiments, angle A is about zero degrees (i.e., the fibers are substantially parallel with major axis $M_3$). In some embodiments, angle A is about 90 degrees (i.e., the fibers are substantially perpendicular to major axis $M_3$ (i.e., circumferentially wrapping soluble core 300)). In some embodiments, angle A is between 30 degrees and 60 degrees, or even between 40 degrees and 50 degrees.

In some embodiments, an additional ply or plies of substantially continuous fibers may be applied to the soluble core. In some embodiments, an additional ply may overlap all or a portion of one or more other plies. In some embodiments, an additional ply may be substantially coextensive with the soluble core. In some embodiments, the ply may cover greater than about 90% by area, or greater than about 95%, or even greater than about 99% of the major surface of the core. In some embodiments, an additional ply may abut one or more other plies. Each ply may independently form any angle from zero degrees to 90 degrees, inclusive with major axis $M_3$.

Turning to FIG. 3B, exemplary MMC article 330 is shown, comprising first MMC region 322, second MMC region 323, and metal region 324. First MMC region 322, which comprises first thread 350*a* and second thread 350*b*, corresponding to grooves 305*a* and 305*b*, respectively, comprises first ply of substantially continuous fibers 301 (not shown) and first metal 341 that infiltrated first ply 301. Similarly, second MMC region 323 comprises second ply 302 (not shown) and second metal 342 that infiltrated second ply 302. Finally, metal region 324 comprises third metal 343. Each metal (i.e., first metal 341, second metal 342, and third metal 343) is independently selected and each metal may be the same as or different from one or more of the other metal used to make MMC article 310.

Referring to FIG. 3C, an expanded view of a threaded region of MMC article 330 is illustrated. In FIG. 3C, MMC article 330 is shown by shadow lines so that the encapsulated fibers can be shown. First ply of substantially continuous fibers 301 is aligned with thread 350*a*. Second ply of substantially continuous fibers 302 are aligned at angle A with major axis $M_3$. Generally, the fibers within first ply 301 are not severed and remain substantially continuous within thread 350*a*.

In some embodiments, the metal region is minimized or even eliminated by, for example, selection of the mold cavity. In some embodiments, additional MMC and/or metal regions may be formed. For each region, the substantially continuous fibers and/or the metal are independently selected. Each region may be formed in the same or in a different casting operation as one or more other regions.

In some embodiments, MMC articles of the present invention can be used, for example, as connecting projectile tubes, actuator components (e.g., push-pull devices), torsional rods or members, oil drilling tubing, structural members (e.g., space craft and/or aircraft tubing), and mechanical power transmission elements.

The following specific, but non-limiting, example will serve to illustrate the invention. In this example, all percentages are parts by weight unless otherwise indicated.

EXAMPLE

A 22.7 kilogram (50 pound) salt block (available from North American Salt Co., Overland Park, Kans.) was conventionally machined from its original dimensions (approximately 22 centimeters (cm) (8.5 inches (in.)) by 22 cm (8.5 in.) by 25 cm (10 in.)) into a cylinder (7 cm (2.88 in.) long by 8 cm (3.25 in.) in diameter) using an industrial lathe (Nardini Lathe, Model No. TT1230E available from McDowell Machinery, Dallas, Tex.). The entire length of the cylinder of salt was further machined to produce a negative casting mold having a groove corresponding to a right-handed ACME thread having a pitch of 0.43 cm (0.17 in.) and a depth of 0.25 cm (0.10 in), with 2.3 threads per centimeter (5.9 threads per inch).

Substantially continuous fibers in the form of a water-sized alumina roving material "NEXTEL 610 ROVING MATERIAL" available from 3M Company, St. Paul, Minn. were aligned with and wound into the groove until the groove was substantially filled. The diameter of individual fibers within a roving was 10 to 12 micrometers. Both 1500 and 3000 denier (grams per 9000 meters) rovings were used. Approximately 50% by volume of the groove was filled with the fibers, with the remaining 50% filled by the spaces between the fibers.

Next, plies of 250 micrometer (0.010 in.) thick prepreg material were applied to the surface of the cylinder. The prepreg material, which comprised 60 percent by volume alpha-alumina fiber (available under the trade designation "NEXTEL 610" from 3M Company; 10,000 denier) and 40 percent by volume resin (obtained under the trade designation "EPON 828" from Resolution Performance Products, Houston, Tex.), was made by Aldila Corp, Poway Calif. When applied to the cylinder, the fibers of the first ply of prepreg material were substantially aligned with the major axis of the cylinder. The fibers of the second ply of prepreg material were aligned perpendicular to the cylinder's major axis (i.e., perpendicular to the fibers of the first ply of prepreg material). Additional plies of prepreg material were applied in alternating orientations (i.e., parallel and perpendicular to the major axis of the cylinder) until the outer diameter of the cylinder was 9.9 cm (3.9 in.). A final ply of roving material ("NEXTEL 610 ROVING MATERIAL") was then circumferentially wrapped over the outer ply of prepreg material with the fibers of the roving material aligned perpendicular to the major axis of the cylinder, yielding a fully formed mold component.

This mold component was placed in a resistance-heated oven (NABERTHERM, Model N41, obtained from Nabertherm, New Castle, Del.) that had been preheated to 500° C. The temperature was maintained at 500° C. for 10 hours and then the oven was turned off. The core was removed from the oven and, upon cooling to room temperature, a mold centering mechanism was inserted in a 1.3 cm (0.5 in.) diameter hole in the center of the core. The core was placed in the bottom of a graphite crucible (20 cm (8 in.) long by 10 cm (4 in.) in diameter, available from Graphite Machining, Inc., Topten, Pa.). Approximately 2,200 grams of solid pieces of aluminum alloy (Al-6061 derivative obtained from Belmont Metals, New York, N.Y.) were placed on top of the casting assembly, and a shrouded J-type thermocouple was inserted into the aluminum pieces. Al-6061 derivative contains: Mg: 0.8–1.2%; Fe: 0.04% maximum (max.); Si: 0.4–0.8%; and other: 0.05% max. (individual), 0.15% max. (total); with the balance pure aluminum.

The crucible assembly was placed in a pressure vessel 91.4 cm (36 in.) long by 17.8 cm (7 in.) in diameter (obtained from Process Engineering, Inc., Plaistow, N.H.). The pressure vessel was sealed, a vacuum was pulled to 20 Pascal (150 millitorr), and the chamber was heated to approximately 720° C. using conventional resistance heaters that radially surrounded the casting assembly. When the thermocouple indicated that the aluminum alloy had reached a temperature of approximately 690° C., the heaters were turned off, the vacuum valve was closed, and the pressure vessel interior was pressurized to 9 MPa (1300 psi), forcing the molten metal to infiltrate the plies of substantially continuous fibers.

Upon cooling to ambient temperature, the pressure vessel was opened and the casting core and the case MMC article were removed from the pressure vessel. The excess aluminum located at the top of the casting core and the MMC article was removed using a band saw. The remaining assembly was run under hot tap water (approximately 60° C.) until most of the salt dissolved (about 30 minutes). The assembly was then placed in a hydraulic press to remove the remaining salt core and any aluminum that had infiltrated the salt core.

The resultant cast MMC article had a right-handed thread corresponding to the groove in the salt core, with substantially continuous fibers substantially aligned with the thread.

Various modifications and alterations of this invention will become apparent to those skilled in the art without departing from the scope and spirit of this invention.

What is claimed is:

1. A metal matrix composite article comprising a first major surface, the first major surface including a first thread, wherein the first thread comprises a first metal matrix composite, and wherein the first metal matrix composite comprises a first metal and a first plurality of substantially continuous fibers substantially aligned with the first thread.

2. The metal matrix composite article of claim 1, wherein the first plurality of fibers comprises fibers selected from the group consisting of metal fibers, ceramic fibers, graphite fibers, and combinations thereof.

3. The metal matrix composite article of claim 1, wherein the first plurality of fibers comprises fibers selected from the group consisting of alpha-alumina fibers, aluminosilicate fibers, aluminoborosilicate fibers, boron nitride fibers, silicon carbide fibers, and combinations thereof.

4. The metal matrix composite article of claim 1, wherein the first major surface further comprises at least one additional thread.

5. The metal matrix composite article of claim 1, wherein the first major surface further comprises a second thread.

6. The metal matrix composite article of claim 5, wherein a helix angle of the first thread and a helix angle of the second thread are substantially the same, and optionally wherein the first thread and the second thread are interspersed.

7. The metal matrix composite article of claim 5, wherein the second thread comprises a second metal, optionally wherein the first metal and the second metal are the same metal.

8. The metal matrix composite article of claim 5, wherein the second thread comprises a second plurality of substantially continuous fibers, optionally wherein the first plurality of fibers and the second plurality of fibers comprise the same material.

9. The metal matrix composite article of claim 1, further comprising a third plurality of substantially continuous fibers, optionally wherein an angle between a major axis of the first plurality of fibers and a major axis of the third plurality of fibers is between 30 degrees and 60 degrees.

10. The metal matrix composite article of claim 1, wherein the first metal is selected from the group consisting of aluminum, magnesium, and alloys thereof.

11. The metal matrix composite article of claim 1, further comprising a second major surface opposite the first major surface, and optionally wherein the second surface comprises a third thread.

12. The metal matrix composite article of claim 11, wherein the third thread comprises a third metal, and, optionally, a fourth plurality of substantially continuous fibers substantially aligned with the third thread.

13. The metal matrix composite article of claim 1, wherein the first thread has a helix angle of about zero degrees.

14. A threaded article comprising a cylinder having an interior major surface comprising a thread, wherein the thread comprises a metal and a plurality of substantially continuous fibers.

15. The threaded article of claim 14, wherein the plurality of substantially continuous fibers is substantially aligned with the thread.

16. The threaded article of claim 14, wherein the metal is selected from the group consisting of aluminum, magnesium and alloys thereof, and the plurality of substantially continuous fibers comprise alpha-alumina fibers.

17. The threaded article of claim 14, wherein the plurality of substantially continuous fibers have an aspect ratio of greater than 200.

18. The threaded article of claim 14, wherein the plurality of substantially continuous fibers have an average length of at least 5 centimeters.

* * * * *